United States Patent [19]

Weder et al.

[11] 4,300,312

[45] Nov. 17, 1981

[54] FLOWER POT COVERING

[76] Inventors: Edwin H. Weder; Donald E. Weder, both of 1111 Sixth St., Highland, Ill. 62249

[21] Appl. No.: 94,745

[22] Filed: Nov. 15, 1979

[51] Int. Cl.[3] ..... A01G 9/02

[52] U.S. Cl. ..... 47/72; D11/143

[58] Field of Search ..... 47/39, 72, 41, 41.1, 47/41.11, 41.12, 67, 69, 71, 84; 206/423; D11/143

[56] References Cited

U.S. PATENT DOCUMENTS

| | | | |
|---|---|---|---|
| 1,979,771 | 11/1934 | Potter | 47/41 |
| 2,845,735 | 8/1958 | Werner | 47/72 X |
| 3,962,503 | 6/1976 | Crawford | 47/71 |

FOREIGN PATENT DOCUMENTS

| | | | |
|---|---|---|---|
| 28528 | 5/1907 | Austria | 47/72 |
| 202396 | 3/1959 | Austria | 47/72 |
| 28130 | of 1906 | United Kingdom | 47/72 |

*Primary Examiner*—James R. Feyrer

*Attorney, Agent, or Firm*—Harvey B. Jacobson

[57] ABSTRACT

A substantially planar sheet of thin plastic film is held about the exterior of a flower pot by use of a cradle having a substantially circular base with a plurality of upstanding fingers spaced evenly about the base. The cradle is produced in a size just slightly larger than the flower pot it is to be used with such that the thin plastic film is held tightly against the sides of the pot in contact with the fingers of the cradle and flares outwardly between the fingers to form a decorative, aesthetically pleasing covering.

2 Claims, 4 Drawing Figures

FLOWER POT COVERING

BACKGROUND OF THE INVENTION

1. Field of the Invention

This invention relates to coverings for flower pots and the like.

2. Discussion of Related Art

In the marketing of floral arrangements, plants and the like, it is often desirable to enhance the beauty of the article by providing a decorative covering to the flower pot which is ordinarily rather bland in appearance. A good flower wrap would normally be inexpensive to manufacture, easy to apply and aesthetically pleasing to the eye.

Many attempts have been made to provide an ideal flower pot wrapping arrangement. Among these suggested coverings for floral containers is that shown in U.S. Pat. No. 3,962,503, issued June 8, 1976, to Crawford. The Crawford patent shows a decorative and protective cover for floral containers which cover is produced from a sheet of foil, plastic or processed paper and is held around a flower pot by use of a ribbon or band surrounding the sheet. U.S. Pat. No. 2,355,559, issued Aug. 8, 1944 to Renner shows a similar covering comprising a plurality of superimposed, transparent sheets formed with an embossed or dished partially rigid central portion and, a wavey, frilly portion surrounding the central portion. The sheets are fused together peripherally around the dished portion. U.S. Pat. No. 1,868,853, issued July 26, 1932 to Sievers, shows a flower pot holder comprising a jacket surrounding a flower pot and held in place by a tie band applied to the exterior of the jacket. U.S. Pat. No. 4,043,077, issued Aug. 23, 1977 to Stonehocker, shows an expandable pot for containing plants which includes an inner flexible container mounted in a base having a plurality of upstanding stops for limiting outward movement of the flexible container. The upstanding stops overlap one another and engage the container in a continuous manner about its exterior.

SUMMARY OF THE INVENTION

One object of the present invention is to provide a flower pot covering which can easily be applied to the exterior of the flower pot to enhance the beauty thereof.

A further object of the present invention is to provide a flower pot covering which can be manufactured relatively easily and inexpensively in various sizes for use on various sized pots.

An even still further object of the present invention is to provide a flower pot covering which can be used to both enhance the beauty of the flower pot and also provide a water resistant barrier about the exterior of the flower pot.

In accordance with the above objects, the present invention includes a substantially planar sheet of thin plastic film which is flexible and water resistant. The plastic film is used to surround the exterior of the flower pot to be decorated and held in place by a cradle which is sized in accordance with the pot to be covered. The cradle includes a circular or diskshaped base upon which the plastic sheet and the flower pot rest. Attached to the base are a plurality of upstanding, relative thin fingers which press against the outer periphery of the flower pot being covered. These fingers are spaced evenly along the base by a distance sufficient to allow the plastic sheet to flare outwardly between them. In this manner, the plastic sheet is held against the side of the flower pot in a convoluted configuration with waves extending inwardly to and touching the flower pot within the vicinity of the fingers, the waves extending outwardly from and spaced from the flower pot between the position of the fingers. The thin plastic film sheath can have a design of various colors or a doily effect imprinted thereon to enhance the visual effect.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
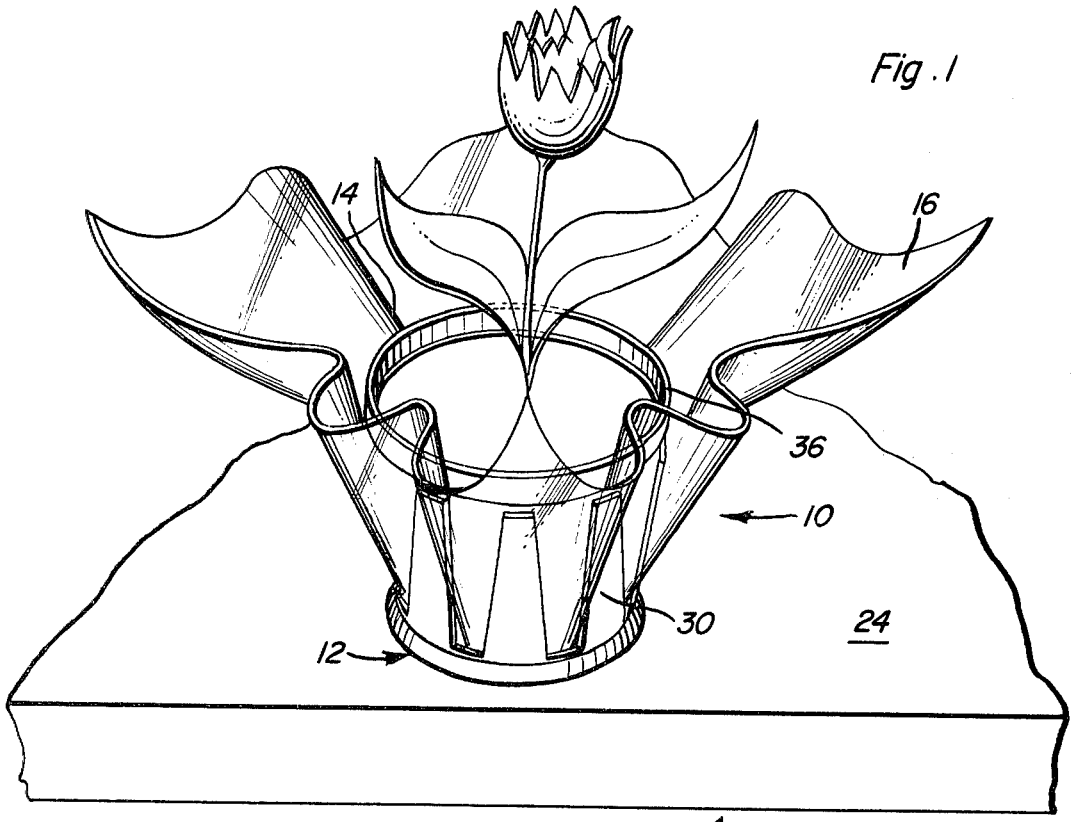
FIG. 1 is a perspective view of the flower pot covering in position on a flower pot.
Figure 2:
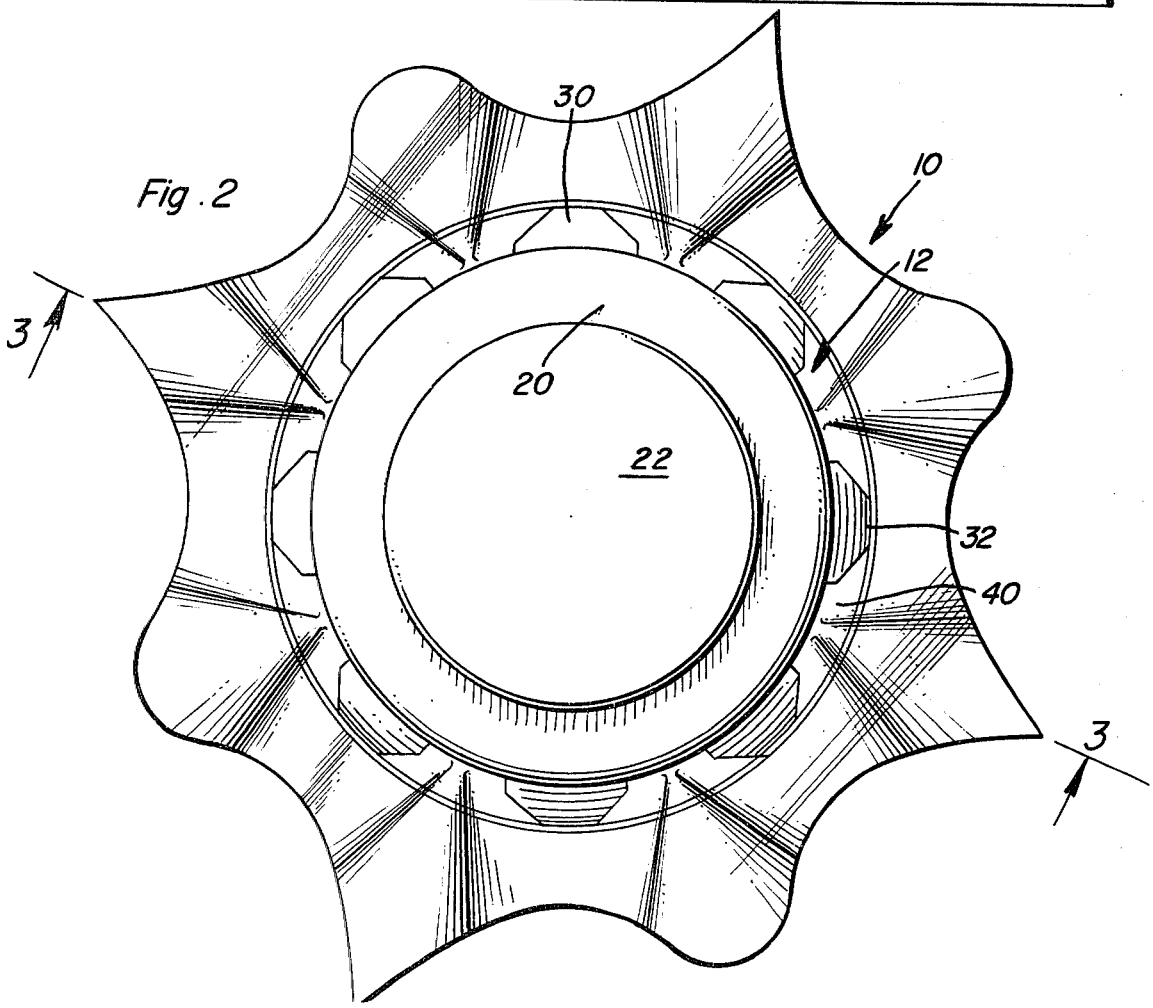
FIG. 2 is a bottom plan view of the flower pot covering of FIG. 1.
Figure 3:
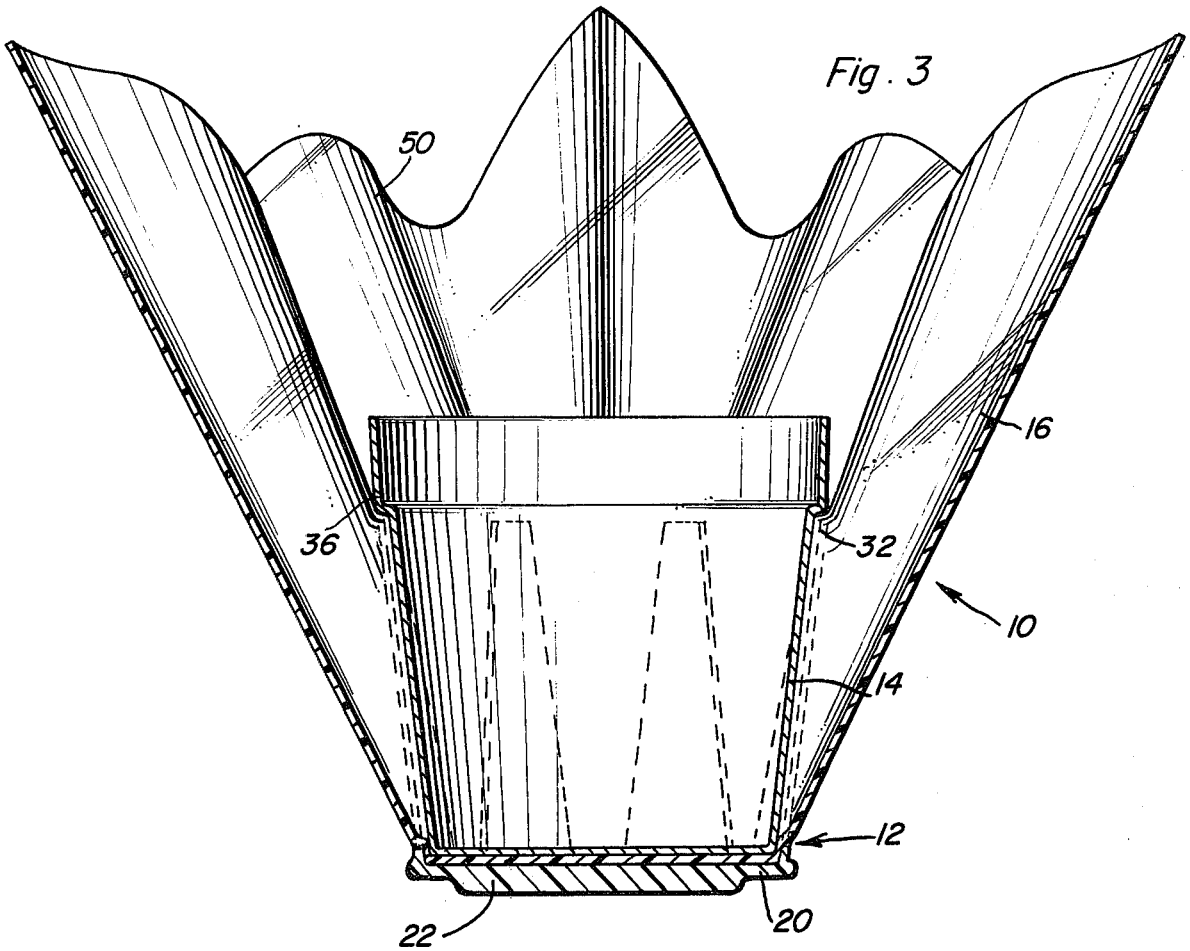
FIG. 3 is an elevational sectional view taken substantially along a plane passing through section line 3—3 of FIG. 2.

Now with reference to the drawings, a flower pot covering incorporating the principles and concepts of the present invention and generally referred to by the reference numeral 10 is described in detail. Covering 10 includes a cradle portion at 12 which surrounds the flower pot 14 and is sized to fit snugly against the outer periphery of the flower pot. A sheet 16 of thin plastic film is disposed around the outside of the flower pot between the flower pot and the cradle 12 and is held firmly in place by the cradle.

The cradle consists of a base 20 which is substantially circular in shape and supports the bottom of the flower pot 14. A support portion 22 is formed in the base 20 and projects downwardly therefrom to support the entire structure on a table 24 or the like. Attached to the outer periphery of the base 20 are a plurality of fingers 30 which are formed integrally with the base and extend upwardly therefrom. Each finger also angles outwardly from the base slightly in order to contact the side of flower pot 14. Each finger is wedge-shaped in appearance having a lower portion attached to the base 20 with the width of the finger tapering as it rises and ending in a relatively narrow free end 32 which is adapted to be disposed adjacent the lower edge of the flower pot upper lip 36. Fingers 30 are spaced about the base 20 in equal intervals to form openings 40 between adjacent fingers. Openings 40 have an average width which is greater than the average width of each finger 30.

Figure 4:
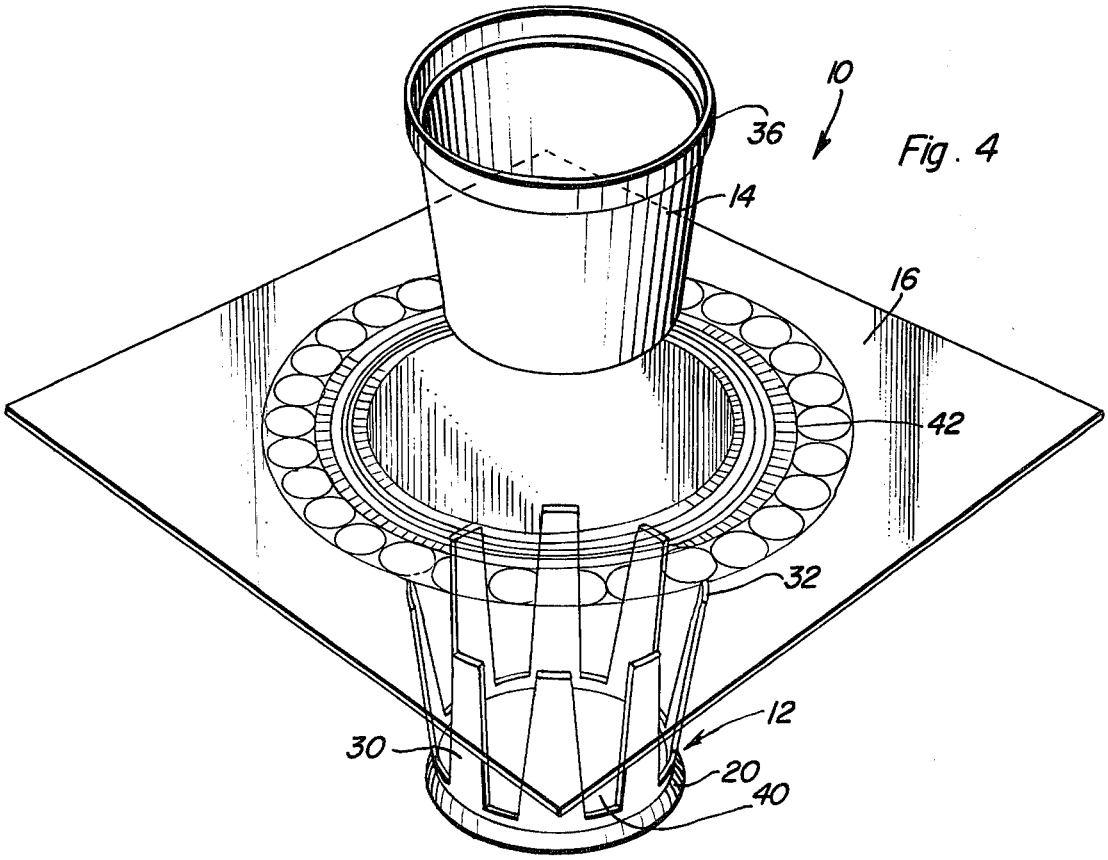
FIG. 4 is an exploded view showing the flower pot covering being applied to a flower pot.

The sheet 16 of thin plastic film is substantially planar in configuration and can be cut in rectangles as shown. Further, a circular pattern as shown in FIG. 4 at 42 can be imprinted on the sheet 16 to produce an attractive doily effect or the like about the flower pot. The sheet 16 can be transparent or opaque as desired and colored with any attractive coloring agent as well as possess a design as shown at 42.

In use, the sheet 16 is wrapped around the pot 14 with cradle 12 being slid over the pot and the sheet. The sheet is held firmly against the pot by fingers 30 and portions of the sheet in openings 40 are pulled away from the pot to form a ripple effect as shown with the loose portions of the sheet extending from the base 20 outwardly up to the sheet free edge 50 which is flared out and ripples about the upper surface of the pot.

It should be understood that the cradle 12 can be formed of any suitable material such as plastic or the like. The base can also be produced from wire with the based being formed from circular wire and each finger 30 being formed from a single upwardly extending wire element. This would produce even greater distance between adjacent fingers and allow the flaring of the sheet 16 to be increased substantially.

By use of the flower pot covering 10 as shown, the pot 14 is enhanced in appearance and therefore salability. Further, the table 24 on which the pot rests is protected from water damage since sheet 16 is completely impervious to water and therefore maintains any moisture within the pot itself. Further, when a plastic base 20 is used, the surface of table 24 is protected from marring from the use of, for example, clay pots.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A structure for holding a substantially planar sheet of thin flexible film wrapped around a flower pot comprising cradle means for holding said sheet against the side of the pot being covered, said cradle means including a plurality of projections extending axially of the pot to be covered for holding the sheet directly against the pot at predetermined spaced positions along the periphery of the pot, said cradle means further including an imperforate base portion for covering and supporting the bottom of the pot, said base portion being larger in area than the bottom of the pot, said projections being attached to said base portion and spaced along the periphery thereof, said projections extending upwardly along the exterior of the pot over a major portion of its height for gripping a sheet placed between the pot and said cradle means and defining spaces between adjacent projections of sufficient width to permit the sheet to flare outwardly therein to produce a decorative convoluted effect.

2. In combination with a flower pot, a covering for said flower pot, said covering comprising a cradle sized to contact the exterior of said flower pot and including a base having a plurality of upstanding fingers attached peripherally of said base and extending axially of said pot with the fingers extending along a major portion of the height of the flower pot; a flexible sheet of thin film disposed between said cradle and said flower pot, said sheet being held directly against said flower pot by said upstanding fingers and flaring outwardly from said flower pot between said fingers, said flexible sheet having dimensional characteristics to completely enclose the bottom and peripheral wall of the flower pot with a peripheral edge of the sheet projecting above the top of the flower pot with the sheet initially being substantially square in configuration to provide outwardly projecting convolutions of increasing size from the bottom portion of the pot upwardly toward the free edge of the flexible sheet, said flexible sheet being constructed of water impervious material and having decorative material thereon observable when the flexible sheet is positioned around the flower pot and held in place by said cradle, said flexible sheet being constructed of plastic material wherein the convolutions are generally smoothly curved, said cradle fingers engaging the external surface of the flexible sheet and resiliently clamping a major length portion of the sheet against the exterior surface of the pot, said pot including a peripheral rim adjacent the upper edge thereof with the fingers terminating adjacent said rim to further resiliently grip the flexible sheet where it is offset to conform with the upper edge of the pot.

* * * * *